US007850438B2

(12) United States Patent
Sato et al.

(10) Patent No.: US 7,850,438 B2
(45) Date of Patent: Dec. 14, 2010

(54) SCROLL FLUID MACHINE WITH BACK PRESSURE CHAMBER SEALING

(75) Inventors: Hajime Sato, Aichi (JP); Yoshiyuki Kimata, Aichi (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 442 days.

(21) Appl. No.: 11/990,004

(22) PCT Filed: Jan. 15, 2008

(86) PCT No.: PCT/JP2008/050318

§ 371 (c)(1),
(2), (4) Date: Feb. 5, 2008

(87) PCT Pub. No.: WO2008/087923

PCT Pub. Date: Jul. 24, 2008

(65) Prior Publication Data

US 2010/0158732 A1 Jun. 24, 2010

(30) Foreign Application Priority Data

Jan. 15, 2007 (JP) ..... 2007-005853

(51) Int. Cl.
*F04C 18/00* (2006.01)

(52) U.S. Cl. ..... 418/55.3; 418/55.2; 418/55.4; 418/57; 464/102

(58) Field of Classification Search ..... 418/55.3, 418/55.1, 55.2, 55.4, 57; 464/102, 103, 77, 464/104, 105
See application file for complete search history.

(56) References Cited

U.S. PATENT DOCUMENTS

| | | | | |
|---|---|---|---|---|
| 5,242,284 | A * | 9/1993 | Mitsunaga et al. | 418/55.3 |
| 5,593,295 | A * | 1/1997 | Hill | 418/55.2 |
| 6,719,545 | B2 * | 4/2004 | Iizuka | 418/55.3 |
| 2010/0111741 | A1 * | 5/2010 | Chikano et al. | 418/55.2 |

FOREIGN PATENT DOCUMENTS

| | | | |
|---|---|---|---|
| JP | 9-158849 | A | 6/1997 |
| JP | 2002-054583 | A | 2/2002 |
| JP | 2003-343452 | A | 12/2003 |
| JP | 2004-19527 | A | 1/2004 |

OTHER PUBLICATIONS

International Search Report of PCT/JP2008/050318, date of mailing date Feb. 19, 2008.

* cited by examiner

*Primary Examiner*—Thomas E Denion
*Assistant Examiner*—Mary A Davis
(74) *Attorney, Agent, or Firm*—Westerman, Hattori, Daniels & Adrian, LLP

(57) ABSTRACT

To provide a scroll type fluid machine which can ensure that even when the pressure ratio of the pressure P1 of its high pressure chamber (back pressure chamber) to the pressure P2 of its low pressure chamber (P1/P2) is low, its orbiting scroll be pressed against its fixed scroll without having its orbiting scroll increased in diameter to prevent any leakage of a fluid through between the front end face of the wall of its orbiting scroll and the bottom face of the end plate of its fixed scroll. The scroll type fluid machine has an Oldham's keyway (17) formed along the edge of the back side of the orbiting scroll end plate (13*a*) for holding one end portion of an Oldham's ring (10) slidably, and a sealing member (18) has a tongue part (18*a*) formed to cut off the flow of any fluid from the back pressure chamber to the Oldham's keyway (17).

13 Claims, 7 Drawing Sheets

SCROLL FLUID MACHINE WITH BACK PRESSURE CHAMBER SEALING

TECHNICAL FIELD

The present invention relates to a scroll type fluid machine employed in an air conditioner, or the like.

BACKGROUND ART

A back pressure type scroll compressor (scroll type fluid machine) is used for compressing a gaseous refrigerant in a refrigerant circuit in, for example, an air conditioner such as a room air conditioner or a package air conditioner.

What is disclosed in Patent Document 1 is, for example, known as such a back pressure type scroll compressor.

Patent Document 1: Japanese Unexamined Patent Application, Publication No. 2003-343452 (FIG. 9)

DISCLOSURE OF INVENTION

While the maintenance of the global environment has recently been attracting growing attention, it is feared that a chlorofluorocarbon refrigerant used as a refrigerant in an air conditioner, such as R134a, may promote global warming. Research is under way for an air conditioner employing a substance originally existing in nature, or a natural refrigerant as a substance replacing such a chlorofluorocarbon refrigerant.

Carbon dioxide (hereinafter expressed as "$CO_2$") is drawing attention as a possible chlorofluorocarbon substitute. $CO_2$ is highly evaluated not only as its influence for global warming is by far less than that of the chlorofluorocarbons, but also as it is not combustible, and is basically harmless to the human body.

However, even when $CO_2$ is compressed by the back pressure type scroll compressor as disclosed in Patent Document 1, a pressure ratio of the pressure P1 of its high pressure chamber (back pressure chamber) to the pressure P2 of its low pressure chamber (P1/P2) is lower than what has hitherto been available with a chlorofluorocarbon refrigerant. Accordingly, there has arisen deficiency of a force pressing an orbiting scroll against a fixed scroll, resulting in the fear that the leakage of $CO_2$ through between the front end face of the wall of the orbiting scroll and the bottom face of the end plate of the fixed scroll may bring about a lower compression efficiency.

The present invention has been made in view of the circumstances as stated above and is aimed at providing a scroll type fluid machine which can ensure that even when the pressure ratio of the pressure P1 of its high pressure chamber (back pressure chamber) to the pressure P2 of its low pressure chamber (P1/P2) is low, its orbiting scroll be pressed against its fixed scroll without having its orbiting scroll increased in diameter to prevent any leakage of a fluid through between the front end face of the wall of its orbiting scroll and the bottom face of the end plate of its fixed scroll.

The present invention has adopted the following means for solving the problem as stated above.

The scroll type fluid machine according to a first aspect of the present invention is a scroll type fluid machine comprising a housing, an orbiting scroll so supported in the housing as to be capable of rotating motion, an Oldham's ring preventing the rotation of the orbiting scroll, a fixed member situated on the back side of the orbiting scroll and fixed to the housing, a back pressure chamber formed between the orbiting scroll and the fixed member and a sealing member situated between the fixed member and the orbiting scroll for sealing the back pressure chamber, the orbiting scroll having an Oldham's keyway formed along the edge of its back side for holding one end portion of the Oldham's ring slidably, wherein the sealing member has a tongue part formed to cut off the flow of any fluid from the back pressure chamber to the Oldham's keyway.

The scroll type fluid machine according to the first aspect as set forth above makes it possible to cover (close) the inner peripheral edge of the Oldham's keyway with the tongue part of the sealing member even if the orbiting motion of the orbiting scroll may cause the Oldham's keyway and the sealing member to overlap each other (for example, as shown in FIG. 2).

This makes it possible to increase the inside diameter (back pressure diameter) of the sealing member and increase the pressure receiving area on the back side of the end plate of the orbiting scroll without enlarging the diameter of the orbiting scroll.

Therefore, it is possible to ensure that even when the pressure ratio of the pressure P1 of the high pressure chamber (back pressure chamber) to the pressure P2 of the low pressure chamber (P1/P2) is low, the orbiting scroll be pressed against the fixed scroll without having the orbiting scroll increased in diameter to prevent any leakage of a refrigerant gas through between the front end face of the wall of the orbiting scroll and the bottom face of the end plate of the fixed scroll and thereby prevent any lowering of compression efficiency.

The scroll type fluid machine according to a second aspect of the present invention is a scroll type fluid machine comprising a housing, an orbiting scroll so supported in the housing as to be capable of orbiting motion, an Oldham's ring preventing the rotation of the orbiting scroll, a fixed member situated on the back side of the orbiting scroll and fixed to the housing, a back pressure chamber formed between the orbiting scroll and the fixed member and a sealing member situated between the fixed member and the orbiting scroll for sealing the back pressure chamber, the orbiting scroll having an Oldham's keyway formed along the edge of its back side for holding one end portion of the Oldham's ring slidably, wherein a plate is situated between the sealing member and the orbiting scroll and has a tongue part formed to cut off the flow of any fluid from the back pressure chamber to the Oldham's keyway.

The scroll type fluid machine according to the second aspect as set forth above makes it possible to cover (close) the inner peripheral edge of the Oldham's keyway with the tongue part of the plate even if the orbiting motion of the orbiting scroll may cause the Oldham's keyway and the plate to overlap each other (for example, as shown in FIGS. 3A and 3B).

This makes it possible to increase the inside diameters (back pressure diameters) of the plate and sealing member and increase the pressure receiving area on the back side of the end plate of the orbiting scroll without enlarging the diameter of the orbiting scroll.

Therefore, it is possible to ensure that even when the pressure ratio of the pressure P1 of the high pressure chamber (back pressure chamber) to the pressure P2 of the low pressure chamber (P1/P2) is low, the orbiting scroll be pressed against the fixed scroll without having the orbiting scroll increased in diameter to prevent any leakage of a refrigerant gas through between the front end face of the wall of the orbiting scroll and the bottom face of the end plate of the fixed scroll and thereby prevent any lowering of compression efficiency.

The formation of the tongue part on the plate which is easy to work on eliminates the necessity of forming the tongue part on the sealing member which is difficult to work on, and makes it possible to form the sealing member with a simple shape (a ring shape having a substantially uniform width along its circumference) and simplify the process for the preparation of the sealing member, thereby achieving an improved productivity.

The scroll type fluid machine is preferably so constructed that the fixed member may have a thrust part formed to support the orbiting scroll during the non-orbiting motion of the orbiting scroll and having a shoulder part formed at its end and along its inner circumference to receive the outer peripheral edge of the plate, so that the plate may have its inner peripheral edge supported by the sealing member, while its outer peripheral edge is supported by the shoulder part.

According to the scroll type fluid machine as described, a force with which the surface situated at the inner peripheral edge of the plate is pressed against the back face of the end plate of the orbiting scroll and a force with which one end face of the sealing member is pressed against the upper face of the fixed member cancel each other, since those forces are substantially equal and are directed in opposite directions.

This makes it possible to reduce a force of friction produced between the front face of the plate and the back face of the end plate of the orbiting scroll and reduce any friction loss caused by the rotation of the orbiting scroll to thereby reduce the wear of the orbiting scroll and/or plate.

The scroll type fluid machine preferably has its sealing member or plate attached to its fixed member by a positioning part.

According to the scroll type fluid machine as described, its positioning part prevents the circumferential movement (rotation) of the sealing member or plate and makes it possible to reduce any friction loss caused by the rotation of the orbiting scroll and reduce the wear of the orbiting scroll, sealing member and plate.

The scroll type fluid machine preferably has its tongue part so formed that when the orbiting of the orbiting scroll has caused the Oldham's keyway and the sealing member or plate to overlap each other, the Oldham's keyway and the high pressure chamber may slightly communicate with each other through an opening formed in the vicinity of the inner peripheral edge of the Oldham's keyway.

The scroll type fluid machine makes it possible for the Oldham's keyway and the high pressure chamber to communicate slightly with each other through the opening formed in the vicinity of the inner peripheral edge of the Oldham's keyway, allowing a fluid containing a lubricant to flow from the high pressure chamber to the Oldham's keyway, when the orbiting of the orbiting scroll has caused the Oldham's keyway and the sealing member or plate to overlap each other (for example, as shown in FIG. 7).

This makes it possible to supply the lubricant to the Oldham's ring sliding in the Oldham's keyway (lubricate it) and improve the lubrication of the Oldham' ring.

The scroll type fluid machine preferably has a communicating groove formed in the front face of the tongue part or the back face of the orbiting scroll to allow the Oldham's keyway and the high pressure chamber to communicate slightly with each other when the orbiting motion of the orbiting scroll has caused the Oldham's keyway and the sealing member or plate to overlap each other.

The scroll type fluid machine makes it possible for the Oldham's keyway and the high pressure chamber to communicate slightly with each other through the communicating groove, allowing a fluid containing a lubricant to flow from the high pressure chamber to the Oldham's keyway, when the orbiting motion of the orbiting scroll has caused the Oldham's keyway and the sealing member or plate to overlap each other (for example, as shown in FIG. 8).

This makes it possible to supply the lubricant to the Oldham's ring sliding in the Oldham's keyway (lubricate it) and improve the lubrication of the Oldham' ring.

The scroll type fluid machine preferably has a chamfered or curved portion formed along the periphery of the Oldham's keyway.

According to the scroll type fluid machine as set forth above, the sealing member or plate has its surface protected from being damaged by the edge of the Oldham's keyway and can maintain its sealing property for a long period of time.

The air conditioning apparatus according to a third aspect of the present invention includes as a compressor a scroll type fluid machine which can ensure that even when the pressure ratio of the pressure P1 of its high pressure chamber (back pressure chamber) to the pressure P2 of its low pressure chamber (P1/P2) is low, its orbiting scroll be pressed against its fixed scroll without having its orbiting scroll increased in diameter to prevent any leakage of a fluid through between the front end face of the wall of its orbiting scroll and the bottom face of the end plate of its fixed scroll, and the apparatus can, as a whole, be improved in efficiency and reduced in size.

The present invention exhibits the advantage of being able to ensure that even when the pressure ratio of the pressure P1 of the high pressure chamber (back pressure chamber) to the pressure P2 of the low pressure chamber (P1/P2) is low, the orbiting scroll be pressed against the fixed scroll without having the orbiting scroll increased in diameter to prevent any leakage of a fluid through between the front end face of the wall of the orbiting scroll and the bottom face of the end plate of the fixed scroll.

EXPLANATION OF REFERENCE

Figure 1:
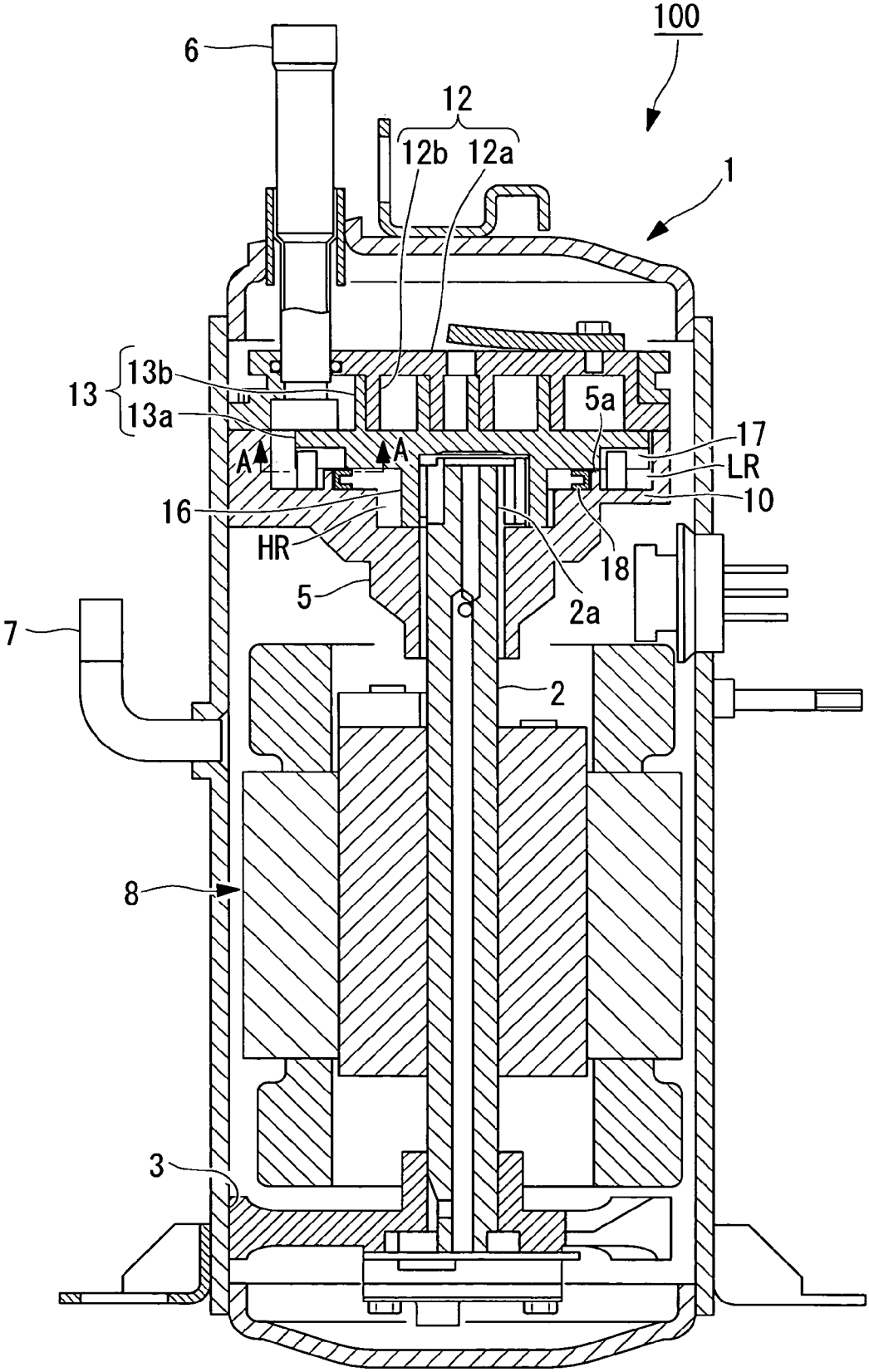
FIG. 1 is a schematic vertical sectional view of a scroll compressor according to a first embodiment of the present invention.

1: housing
5: upper bearing (fixed member)
10: Oldham's ring
13: orbiting scroll
17: Oldham's keyway
18: sealing member
18*a*: tongue part
21: sealing member
22: plate
22*a*: tongue part
31: sealing member
32: plate
32*a*: communicating portion (tongue part)
42: plate
42*a*: communicating portion (tongue part)
43: pin (positioning part)
44: pin groove (positioning part)
51: chamfered part
61: sealing member
61*a*: tongue part
62: opening
71: sealing member
72: communicating groove
81: thrust part
82: shoulder part
100: scroll type fluid machine
HR: back pressure chamber

BEST MODE FOR CARRYING OUT THE INVENTION

Figure 2:
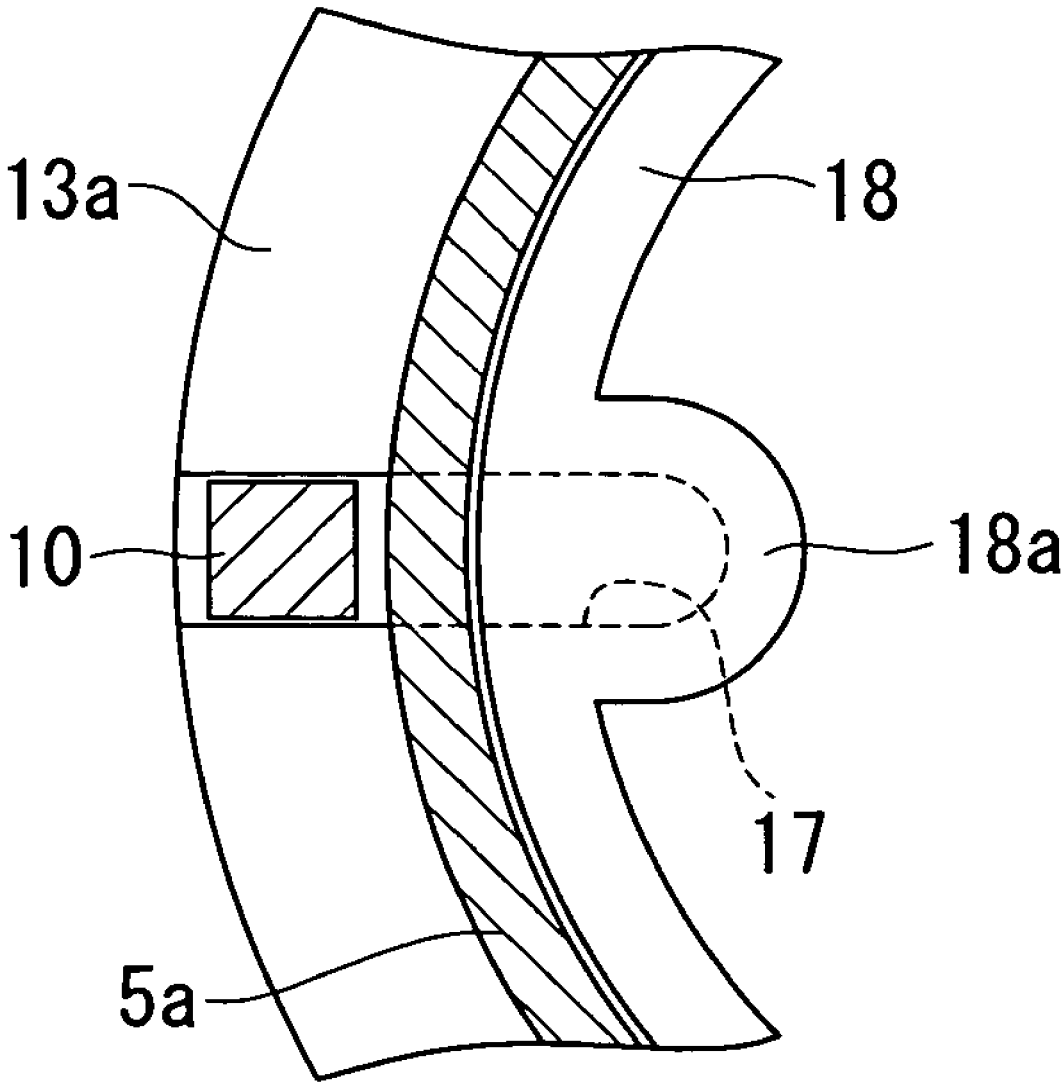
FIG. 2 is a sectional view taken along the line A-A in FIG. 1.

The scroll type fluid machine according to the first embodiment of the present invention will now be described with reference to FIGS. 1 and 2. FIG. 1 is a schematic vertical sectional view of the scroll type fluid machine according to the present embodiment and FIG. 2 is a sectional view taken along the line A-A in FIG. 1.

The scroll type fluid machine 100 (hereinafter referred to as "scroll compressor") according to the present embodiment has a closed housing 1, a crankshaft (revolving shaft) 2, a lower bearing 3 for the crankshaft 2, an upper bearing (fixed member) 5 for the crankshaft 2, an intake pipe 6, a discharge pipe 7, a motor 8 and an Oldham's ring (rotation preventing mechanism) 10 for preventing the rotation of the orbiting scroll 13. Symbol 12 in FIG. 1 denotes a fixed scroll and an orbiting scroll 13 is engaged with the fixed scroll 12.

The fixed scroll 12 has a spiral wall 12*b* erected on one side of an end plate 12*a*.

The orbiting scroll 13 has a spiral wall 13*b* erected on one side of an end plate 13*a* as the fixed scroll 12 does, and its wall 13*b* is substantially equal in shape to the wall 12*b* of the fixed scroll 12. The orbiting scroll 13 is eccentric to the fixed scroll 12 to an extent equal to its orbiting radius and their walls 12*b* and 13*b* are engaged with each other with a phase shift of 180°. A cylindrical boss 16 protrudes from the center of the back face of the end plate 13*a* of the orbiting scroll and an eccentric pin 2*a* formed on the upper end of the crankshaft 2 extends thereinto. Moreover, the end plate 13*a* of the orbiting scroll has an Oldham's keyway 17 formed along the periphery of its back face for holding one end of the Oldham's ring 10 (its upper end as viewed in FIG. 1) slidably.

The upper bearing 5 has a thrust part 5*a* formed around the boss 16 of the orbiting scroll 13 to support the orbiting scroll 13 when the scroll compressor 100 is out of operation. A sealing member 18 shaped like a ring as viewed in top plan is situated between the upper bearing 5 and the orbiting scroll end plate 13*a* and along the inner circumference (radially inwardly) of the thrust part 5*a*.

In the scroll compressor 100 as described, the sealing member 18 defines a high pressure chamber (back pressure chamber) HR beside (below in FIG. 1) the back face of the orbiting scroll end plate 13*a* and centrally of the sealing member 18, while defining a low pressure chamber LR beside the back face of the orbiting scroll end plate 13*a* and outwardly of the sealing member 18, so that the orbiting scroll 13 is pressed against the fixed scroll 12 by the pressure of the high pressure chamber HR.

The sealing member 18 is a member having a U-shaped cross section and is subjected to the radially outward pressure of a high-pressure gas in the high pressure chamber HR and thereby pressed upwardly, downwardly and radially outwardly (i.e. against the back face of the orbiting scroll end plate 13*a*, the upper face of the upper bearing 5 (its surface facing the back face of the orbiting scroll end plate 13*a*) and the inner peripheral surface of the thrust part 5*a*), thereby sealing the high pressure chamber HR, when the scroll compressor 100 is in operation.

The sealing member 18 according to the present embodiment as shown in FIG. 2 has a plurality of tongue parts 18*a* (two in the case of the present embodiment). The tongue parts 18*a* are members having a substantially semicircular shape as viewed in top plan and projecting radially inwardly from the inner peripheral surface of the sealing member 18 in a position (area) corresponding to the Oldham's keyway 17 so as to cover (close) the inner peripheral end (radially inner end) of the Oldham's keyway 17.

The scroll compressor 100 according to the present embodiment enables the tongue parts 18*a* of the sealing member 18 to cover (close) the inner peripheral end of the Oldham's keyway 17 even if the orbiting motion of the orbiting scroll 13 may cause the Oldham's keyway 17 and the sealing member 18 to overlap each other (as shown in FIG. 2).

This makes it possible to increase the inside diameter (back pressure diameter) of the sealing member 18 except its portion (area) having the tongue parts 18*a* and increase the pressure receiving area on the back side of the end plate 13*a* of the orbiting scroll without enlarging the diameter of the orbiting scroll 13.

Therefore, it is possible to ensure that even when the pressure ratio of the pressure P1 of the high pressure chamber HR (back pressure chamber) to the pressure P2 of the low pressure chamber LR (P1/P2) is low, the orbiting scroll 13 be pressed against the fixed scroll 12 without having the orbiting scroll 13 increased in diameter to prevent any leakage of a refrigerant gas through between the front end face of the wall 13*b* of the orbiting scroll 13 and the bottom face of the end plate 12*a* of the fixed scroll.

Figure 3A:
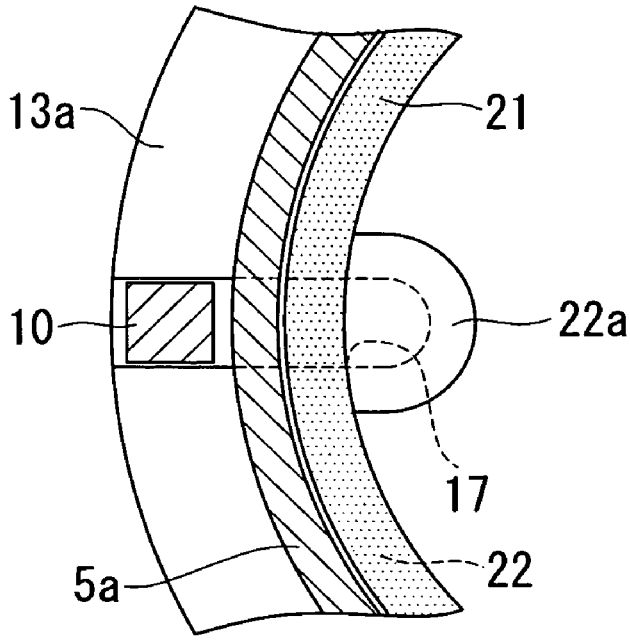
FIG. 3A is a diagram showing a second embodiment of the present invention and a sectional view taken along the line B-B in FIG. 3B.
Figure 3B:
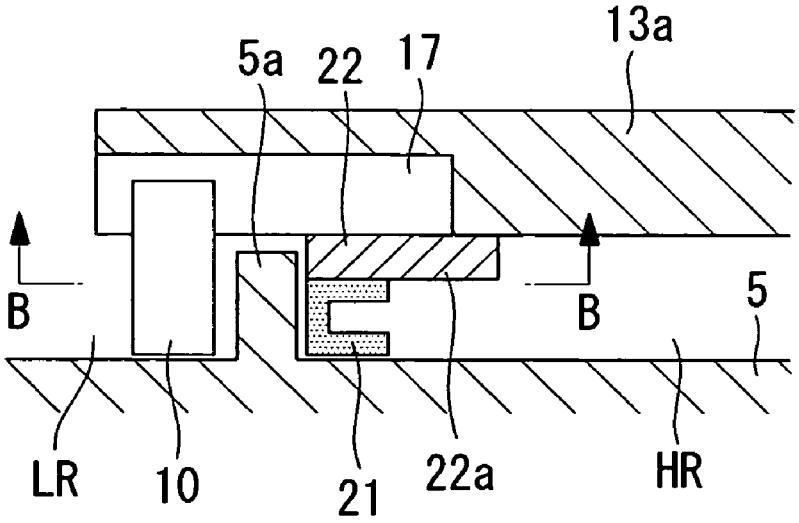
FIG. 3B is an enlarged vertical sectional view of an essential part of the scroll compressor according to the second embodiment of the present invention.

The scroll compressor according to the second embodiment of the present invention will now be described with reference to FIGS. 3A and 3B. FIG. 3A is a view similar to FIG. 2 and is a sectional view taken along the line B-B in FIG. 3B and FIG. 3B is an enlarged vertical sectional view of an essential part of the scroll compressor according to the present embodiment.

The scroll compressor according to the present embodiment is differentiated from that according to the first embodiment as described above by having a sealing member 21 and a plate 22 instead of the sealing member 18.

As the other structural elements thereof are equal to those of the first embodiment described above, their description is omitted and the same symbols as used for the first embodiment described above are used in FIGS. 3A and 3B to denote the same parts or members.

The sealing member 21 is a member situated between the upper bearing 5 and the plate 22 and having a shape like a ring as viewed in top plan and a U-shaped cross section and is subjected to the radially outward pressure of a high-pressure gas in the high pressure chamber HR and thereby pressed upwardly, downwardly and radially outwardly (i.e. against the back face of the plate 22 (its lower face in FIG. 3B), the upper face of the upper bearing 5 (its surface facing the back face of the orbiting scroll end plate 13*a*) and the inner peripheral surface of the thrust part 5*a*), thereby sealing the high pressure chamber HR, when the scroll compressor 100 is in operation.

The sealing member 21 according to the present embodiment does not have any tongue part 18*a* as described in connection with the first embodiment, but has a substantially uniform width along its circumference.

The plate 22 is a plate-like member situated between the orbiting scroll end plate 13*a* and the sealing member 21 and having a shape like a ring as viewed in top plan and a rectangular cross section and has a plurality of tongue parts 22*a* (two in the case of the present embodiment). The tongue parts 22*a* are members having a substantially semicircular shape as viewed in top plan and projecting radially inwardly from the inner peripheral surface of the plate 22 in a position (area) corresponding to the Oldham's keyway 17 so as to cover (close) the inner peripheral end (radially inner end) of the Oldham's keyway 17, like the tongue parts 18*a* described in connection with the first embodiment. The plate 22 excluding its tongue parts 22*a* has a width which is substantially equal to that of the sealing member 21, so that the sealing member 21 and the plate 22 may overlap each other circumferentially.

According to the scroll compressor covered by the present embodiment, the formation of the tongue parts 22*a* on the plate 22 which is easy to work on eliminates the necessity of forming any tongue part on the sealing member 21 which is difficult to work on, and makes it possible to form the sealing member 21 with a simple shape (a ring shape having a substantially uniform width along its circumference) and simplify the process for the preparation of the sealing member 21, thereby achieving an improved productivity.

The other advantages thereof are equal to those of the first embodiment described above, and their explanation is omitted.

Figure 4A:
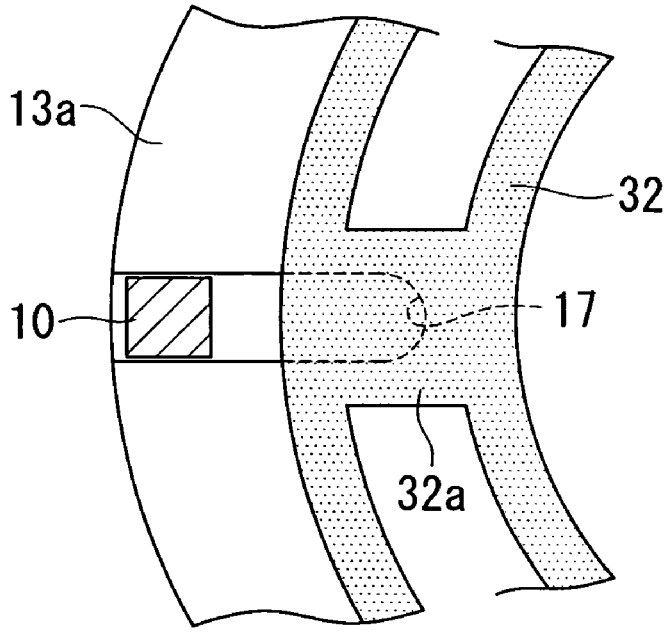
FIG. 4A is a sectional view showing a third embodiment of the present invention and taken along the line C-C in FIG. 4B.
Figure 4B:
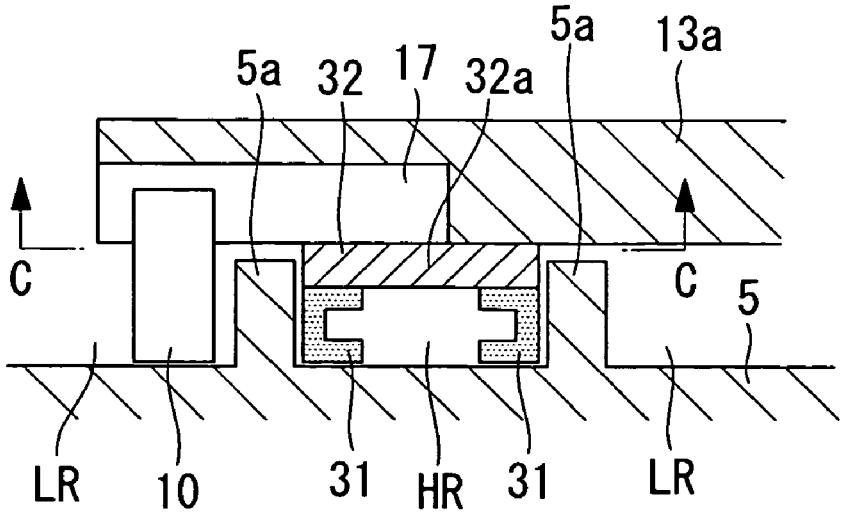
FIG. 4B is an enlarged vertical sectional view of an essential part of the scroll compressor according to the third embodiment of the present invention.

The scroll compressor according to the third embodiment of the present invention will now be described with reference to FIGS. 4A and 4B. FIG. 4A is a view similar to FIG. 3A and is a sectional view taken along the line C-C in FIG. 4B and FIG. 4B is an enlarged vertical sectional view of an essential part of the scroll compressor according to the present embodiment.

The scroll compressor according to the present embodiment is differentiated from that according to the second embodiment as described above by having a low pressure housing (for example, of the type in which a part of the fluid compressed by the fixed and orbiting scrolls 12 and 13 is introduced into the high pressure chamber HR through a pressure introducing hole not shown) and having a sealing member 31 and a plate 32 instead of the sealing member 21 and plate 22.

As the other structural elements thereof are equal to those of the second embodiment described above, their description is omitted and the same symbols as used for the second embodiment described above are used in FIGS. 4A and 4B to denote the same parts or members.

The sealing member 31 is a member situated one each along the outer periphery (radially outwardly) of the high pressure chamber HR defined between the upper bearing 5 and the orbiting scroll end plate 13*a* and along the inner periphery (radially inwardly) thereof and having a shape like a ring as viewed in top plan and a U-shaped cross section and they are subjected to the radially outward pressure of a high-pressure gas in the high pressure chamber HR and thereby pressed upwardly, downwardly and radially outwardly (i.e. against the back face of the plate 32 (its lower face in FIG. 4B), the upper face of the upper bearing 5 (its surface facing the back face of the orbiting scroll end plate 13*a*) and the inner peripheral surface of the thrust part 5*a*), thereby sealing the high pressure chamber HR, when the scroll compressor 100 is in operation.

The sealing members 31 according to the present embodiment have a substantially uniform width along its circumference, like the sealing member 21 described in connection with the second embodiment.

The plate 32 is a plate-like member situated one each along the outer periphery (radially outwardly) of the high pressure chamber HR defined between the upper bearing 5 and the orbiting scroll end plate 13*a* and along the inner periphery (radially inwardly) thereof and having a shape like a ring as viewed in top plan and a rectangular cross section and the ring-shaped member situated along its outer periphery and the ring-shaped member situated along its inner periphery are connected (joined) by a plurality of connecting portions (tongue parts) 32*a* (two in the case of the present embodiment). The connecting portions 32*a* extend radially inwardly from the inner peripheral surface of the ring-shaped member situated along the outer periphery in a position (area) corresponding to the Oldham's keyway 17 so as to cover the inner peripheral end (radially inner end) of the Oldham's keyway 17, like the tongue parts 22*a* described in connection with the second embodiment, while extending radially outwardly from the outer peripheral surface of the ring-shaped member situated along the inner periphery, thereby connecting the ring-shaped member situated along the outer periphery and the ring-shaped member situated along the inner periphery. Each plate 32 excluding its connecting portions 32*a* has a width which is substantially equal to that of each sealing member 31, so that the sealing members 31 and the plates 32 may overlap each other circumferentially.

The advantages are equal to those of the second embodiment described above and their explanation is omitted.

It is possible to eliminate the plates 32 from the present embodiment and connect the sealing member 31 situated along the outer periphery and the sealing member 31 situated along the inner periphery by connecting portions similar to the connecting portions 32*a* described above in a position (area) corresponding to the Oldham's keyway 17.

The connection of the sealing member 31 situated along the outer periphery and the sealing member 31 situated along the inner periphery by the connecting portions makes it possible to stabilize the behavior of the sealing members 31 and thereby improve their sealing property.

Figure 5:
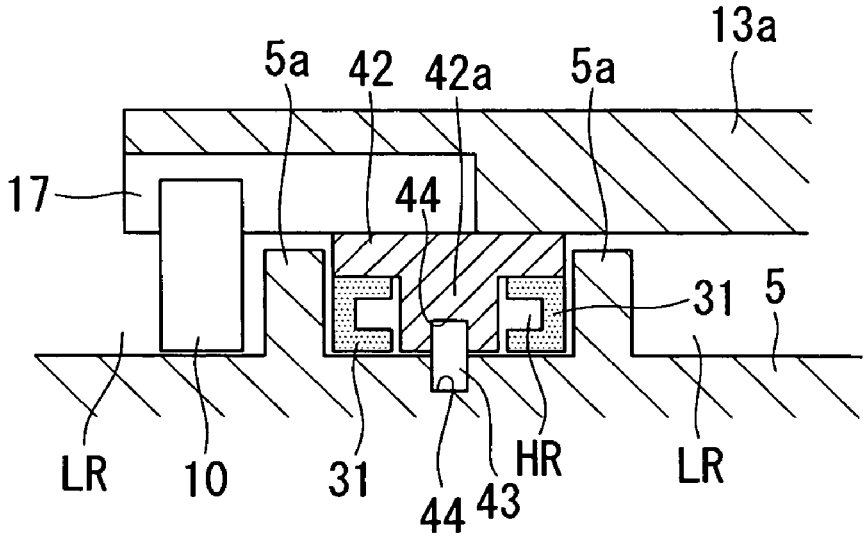
FIG. 5 is a diagram showing a fourth embodiment of the present invention and is a view similar to FIG. 4B, but is an enlarged vertical sectional view of an essential part of the scroll compressor according to that embodiment.

The scroll compressor according to the fourth embodiment of the present invention will now be described with reference to FIG. 5. FIG. 5 is a view similar to FIG. 4B and is an enlarged vertical sectional view of an essential part of the scroll compressor according to the present embodiment.

The scroll compressor according to the present embodiment is differentiated from that according to the third embodiment as described above by having a plate 42 instead of the plates 32.

As the other structural elements thereof are equal to those of the third embodiment described above, their description is omitted and the same symbols as used for the third embodiment described above are used in FIG. 5 to denote the same parts or members.

The plate 42 is a plate-like member situated one each along the outer periphery (radially outwardly) of the high pressure chamber HR defined between the upper bearing 5 and the orbiting scroll end plate 13*a* and along the inner periphery (radially inwardly) thereof and having a shape like a ring as viewed in top plan and a rectangular cross section and the ring-shaped member situated along its outer periphery and the ring-shaped member situated along its inner periphery are connected (joined) by a plurality of connecting portions (tongue parts) 42*a* (two in the case of the present embodiment). The connecting portions 42*a* are members having a T-shaped cross section and extending radially inwardly from the inner peripheral surface of the ring-shaped member situated along the outer periphery in a position (area) corresponding to the Oldham's keyway 17 so as to cover the inner peripheral end (radially inner end) of the Oldham's keyway 17, like the connecting portions 32*a* described in connection with the third embodiment, while extending radially outwardly from the outer peripheral surface of the ring-shaped member situated along the inner periphery, thereby connecting the ring-shaped member situated along the outer periphery and the ring-shaped member situated along the inner periphery. Each plate 42 excluding its connecting portions 42*a* has a width which is substantially equal to that of each sealing member 31, so that the sealing members 31 and the plates 42 may overlap each other circumferentially. The back face of each connecting portion 42*a* (its lower face in FIG. 5) and the upper face of the upper bearing 5 (its surface facing the back face of the orbiting scroll end plate 13*a*) have pin grooves (positioning part) 44 in which pins (positioning part) 43 are received, so that the plates 42 may be positioned by the pins 43.

The scroll compressor according to the present embodiment makes it possible for the pins 43 to prevent the circumferential movement (rotation) of the plates 42, thereby reducing any friction loss caused by the rotation of the orbiting scroll 13 and reducing the wear of the orbiting scroll 13 and/or the plates 42.

The connecting portions 42*a* of the plates 42 which ensure the covering (closing) of the inner peripheral end of the Oldham's keyway 17 make it possible to realize an improved seal.

The other advantages thereof are equal to those of the third embodiment described above and their explanation is omitted.

It is possible to eliminate the plates 42 from the present embodiment, connect the sealing member 31 situated along the outer periphery and the sealing member 31 situated along the inner periphery in a position (area) corresponding to the Oldham's keyway 17 by connecting portions similar to the connecting portions described in connection with the third embodiment and connect the connecting portions and the upper bearing 5 by the pins 43 described above.

Figure 6:
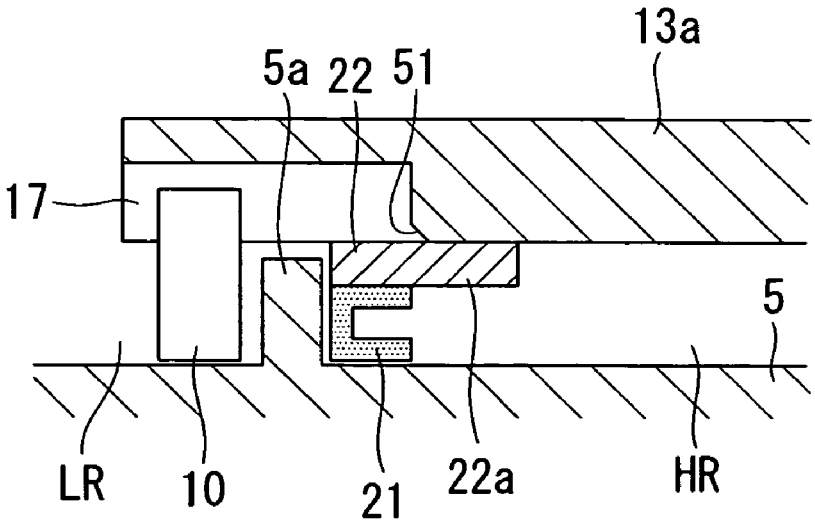
FIG. 6 is a diagram showing a fifth embodiment of the present invention and is a view similar to FIG. 3B, but is an enlarged vertical sectional view of an essential part of the scroll compressor according to that embodiment.

The scroll compressor according to the fifth embodiment of the present invention will now be described with reference to FIG. 6. FIG. 6 is a view similar to FIG. 3B and is an enlarged vertical sectional view of an essential part of the scroll compressor according to the present embodiment.

The scroll compressor according to the present embodiment is differentiated from the embodiment as described above by having a chamfered (or curved) portion 51 along the peripheral edge (peripheral end) of the Oldham's keyway 17.

As the other structural elements thereof are equal to those of the embodiment described above, their description is omitted and the same symbols as used for the second embodiment described above are used in FIG. 6 to denote the same parts or members.

According to the scroll compressor covered by the present embodiment, the plate 22 has its surface (its upper surface in FIG. 6) protected from being damaged by the edge of the Oldham's keyway 17 and can maintain its sealing property for a long period of time.

The other advantages thereof are equal to those of the second embodiment described before and their explanation is omitted.

Figure 7:
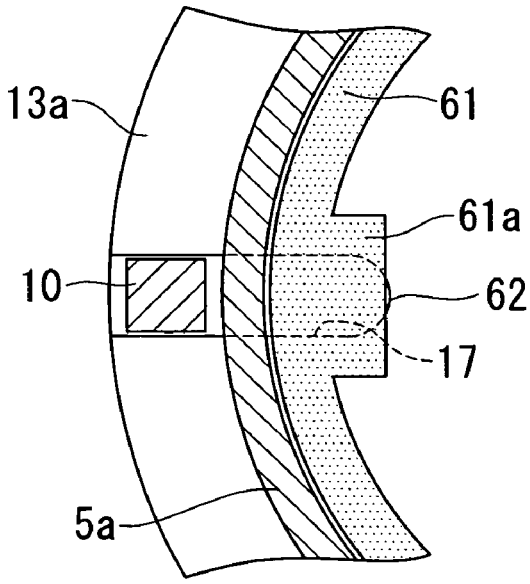
FIG. 7 is a diagram showing a sixth embodiment of the present invention and is a view similar to FIG. 2.

The scroll compressor according to the sixth embodiment of the present invention will now be described with reference to FIG. 7. FIG. 7 is a view similar to FIG. 2.

The scroll compressor according to the present embodiment is differentiated from the first embodiment as described before by having a sealing member 61 instead of the sealing member 18.

As the other structural elements thereof are equal to those of the first embodiment described before, their description is omitted and the same symbols as used for the first embodiment described before are used in FIG. 7 to denote the same parts or members.

The sealing member 61 has a plurality of tongue parts 61*a* (two in the case of the present embodiment). Each tongue part 61*a* is a member having a substantially rectangular shape as viewed in top plan and projecting radially inwardly from the inner peripheral surface of the sealing member 61 in a position (area) corresponding to the Oldham's keyway 17 so as to cover (close) substantially the whole of the inner peripheral end (radially inner end) of the Oldham's keyway 17, and has a front end face (radially inner end face) so formed as to be located somewhat outwardly of the inner peripheral end of the Oldham's keyway 17.

The scroll compressor according to the present embodiment makes it possible for the Oldham's keyway 17 and the high pressure chamber HR to communicate slightly with each other through an opening 62 formed in the vicinity of the inner peripheral edge of the Oldham's keyway 17, allowing a fluid containing a lubricant to flow from the high pressure chamber HR into the Oldham's keyway 17, when the orbiting of the orbiting scroll 13 has caused the Oldham's keyway 17 and the sealing member 61 to overlap each other (as shown in FIG. 7).

This makes it possible to supply the lubricant to the Oldham's ring 10 sliding in the Oldham's keyway 17 (lubricate it) and improve the lubrication of the Oldham's ring 10.

The other advantages are equal to those of the first embodiment as described before and their explanation is omitted.

Figure 8:
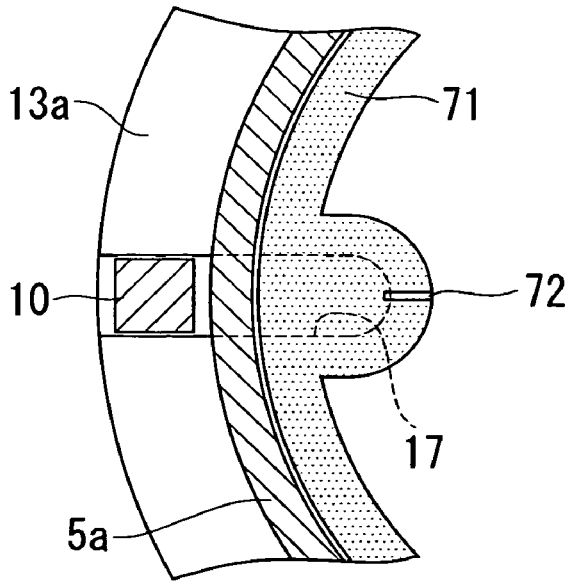
FIG. 8 is a diagram showing a seventh embodiment of the present invention and is a view similar to FIG. 2.

The scroll compressor according to the seventh embodiment of the present invention will now be described with reference to FIG. 8. FIG. 8 is a view similar to FIG. 2.

The scroll compressor according to the present embodiment is differentiated from the first embodiment as described before by having a sealing member 71 instead of the sealing member 18.

As the other structural elements thereof are equal to those of the first embodiment described before, their description is omitted and the same symbols as used for the first embodiment described before are used in FIG. 8 to denote the same parts or members.

The sealing member 71 differs from the sealing member 18 according to the first embodiment described before by having a communicating groove 72 formed in its front surface (its surface facing the back face of the orbiting scroll end plate 13*a*) or in the back face of the orbiting scroll end plate 13*a* for communicating the Oldham's keyway 17 and the high pressure chamber HR with each other.

The scroll compressor according to the present embodiment makes it possible for the Oldham's keyway 17 and the high pressure chamber HR to communicate slightly with each other through the communicating groove 72, allowing a fluid containing a lubricant to flow from the high pressure chamber HR into the Oldham's keyway 17, when the orbiting of the orbiting scroll 13 has caused the Oldham's keyway 17 and the sealing member 71 to overlap each other (as shown in FIG. 8).

This makes it possible to supply the lubricant to the Oldham's ring 10 sliding in the Oldham's keyway 17 (lubricate it) and improve the lubrication of the Oldham's ring 10.

The other advantages are equal to those of the first embodiment as described before and their explanation is omitted.

The shape as viewed in top plan of each tongue part 22*a* as described in connection with the second embodiment may be changed to that of the tongue part 61*a* as described in connection with the sixth embodiment and a communicating groove 72 as described in connection with the seventh embodiment may be formed in the surface of each tongue part 22*a* as described in connection with the second embodiment.

Figure 9:
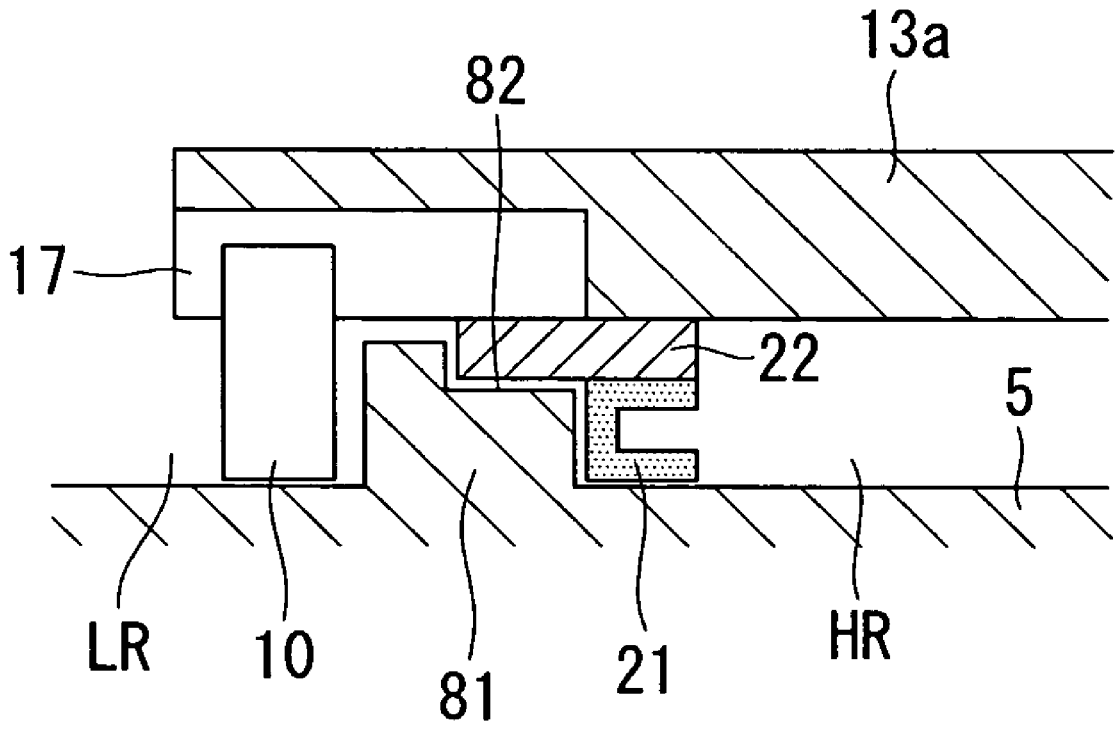
FIG. 9 is a diagram showing an eighth embodiment of the present invention and is a view similar to FIG. 3B, but is an enlarged vertical sectional view of an essential part of the scroll compressor according to that embodiment.

The scroll compressor according to the eighth embodiment of the present invention will now be described with reference to FIG. 9. FIG. 9 is a view similar to FIG. 3B and is an enlarged vertical sectional view of an essential part of the scroll compressor according to the present embodiment.

The scroll compressor according to the present embodiment is differentiated from that according to the second embodiment as described before by having a thrust part 81 instead of the thrust part 5*a*.

As the other structural elements thereof are equal to those of the second embodiment described before, their description is omitted and the same symbols as used for the second embodiment described before are used in FIG. 9 to denote the same parts or members.

The thrust part 81 has a shoulder part (recess) 82 formed at its end (its upper end in FIG. 9) and along its inner circumference (radially inner) to receive the outer peripheral edge (radially outer edge) of the plate 22, so that the plate 22 may have its inner peripheral edge supported by the sealing member 21, while its outer peripheral edge is supported by the shoulder part (recess) 82.

According to the scroll compressor covered by the present embodiment, the sealing member 21 having a U-shaped cross section is subjected to the radially outward pressure of a high-pressure gas in the high pressure chamber HR and thereby pressed upwardly, downwardly and radially outwardly (i.e. against the back face of the plate 22 along its inner peripheral edge, the upper face of the upper bearing 5 (its surface facing the back face of the orbiting scroll end plate 13*a*) and the inner peripheral surface of the thrust part 81), thereby sealing the high pressure chamber HR, when the scroll compressor is in operation. The force with which the surface situated along the inner peripheral edge of the plate 22 is pressed against the back face of the orbiting scroll end plate 13*a* and the force with which one end face of the sealing member 21 (its lower end surface in FIG. 9) is pressed against the upper face of the upper bearing 5 cancel each other, since those forces are substantially equal and are directed in opposite directions.

This makes it possible to reduce a force of friction produced between the front face of the plate 22 and the back face of the orbiting scroll end plate 13*a* and reduce any friction loss caused by the rotation of the orbiting scroll 13 to thereby reduce the wear of the orbiting scroll 13 and/or plate 22.

The other advantages are equal to those of the second embodiment as described before and their explanation is omitted.

The present invention is not limited to its embodiments as described above, but variations are possible without departing from the scope and spirit of the present invention, including a combination of its fifth and sixth embodiments, a combination of its fifth and seventh embodiments and a combination of its fifth and eighth embodiments.

The invention claimed is:

1. A scroll fluid machine comprising a housing, an orbiting scroll supported in the housing so that it moves in an orbiting motion, an Oldham's ring preventing the rotation of the orbiting-scroll, a fixed member situated on the back side of the orbiting scroll and fixed to the housing, a back pressure chamber formed between the orbiting scroll and the fixed member and a sealing member situated between the fixed member and the orbiting scroll for sealing the back pressure chamber, the orbiting scroll having an Oldham's keyway formed along the edge of its back side for holding one end portion of the Oldham's ring slidably, wherein the sealing member has a tongue part that is formed so that when the orbiting of the orbiting scroll has caused the Oldham's keyway and the sealing member to overlap each other, the flow of any fluid remains cut off from the back pressure chamber to the Oldham's keyway.

2. A scroll fluid machine according to claim 1, wherein the Oldham's keyway has a chamfered or curved portion formed along its periphery.

3. An air conditioning apparatus including a scroll fluid machine according to claim 1.

4. A scroll fluid machine comprising a housing, an orbiting scroll supported in the housing so that it revolves and orbits, an Oldham's ring preventing the rotation of the orbiting scroll, a fixed member situated on the back side of the orbiting scroll and fixed to the housing, a back pressure chamber formed between the orbiting scroll and the fixed member and a sealing member situated between the fixed member and the orbiting scroll for sealing the back pressure chamber, the orbiting scroll having an Oldham's keyway formed along the edge of its back side for holding one end portion of the Oldham's ring slidably, wherein a plate is situated between the sealing member and the orbiting scroll and has a tongue part that is formed so that when the orbiting of the orbiting scroll has caused the Oldham's keyway and the plate to overlap each other the flow of any fluid remains cut off from the back pressure chamber to the Oldham's keyway.

5. A scroll fluid machine according to claim 4, wherein the fixed member has a thrust part formed to support the orbiting scroll during the non-orbiting motion of the orbiting scroll and having a shoulder part formed at its end and along its inner circumference to receive the outer peripheral edge of the plate, so that the plate may have its inner peripheral edge supported by the sealing member, while its outer peripheral edge is supported by the shoulder part.

6. A scroll fluid machine according to claim 4, wherein the plate is attached to the fixed member by a positioning part.

7. A scroll fluid machine according to claim 4, wherein the Oldham's keyway has a chamfered or curved portion formed along its periphery.

8. An air conditioning apparatus including a scroll fluid machine according to claim 4.

9. A scroll fluid machine comprising a housing, an orbiting scroll supported in the housing so that it revolves and orbits, an Oldham's ring preventing the rotation of the orbiting scroll, a fixed member situated on the back side of the orbiting scroll and fixed to the housing, a back pressure chamber formed between the orbiting scroll and the fixed member, wherein the back pressure chamber is at a high pressure, and a sealing member situated between the fixed member and the orbiting scroll for sealing the back pressure chamber, the orbiting scroll having an Oldham's keyway formed along the edge of its back side for holding one end portion of the Oldham's ring slidably, wherein the Oldham's keyway is at a low pressure, wherein either a plate or the sealing member has a tongue part and is formed so that when the orbiting of the orbiting scroll has caused the Oldham's keyway and the sealing member or plate to overlap each other, the Oldham's keyway and the back pressure chamber will slightly communicate with each other.

10. A scroll fluid machine according to claim 9, wherein the tongue part is formed on the sealing member and is so formed that when the orbiting of the orbiting scroll has caused the Oldham's keyway and the sealing member to overlap each other, the Oldham's keyway and the high pressure chamber will slightly communicate with each other through an opening formed in the vicinity of the inner peripheral edge of the Oldham's keyway.

11. A scroll fluid machine according to claim 9, wherein the tongue part is formed on the sealing member and the front face of the tongue part or the back face of the orbiting scroll has a communicating groove formed to allow the Oldham's keyway and the high pressure chamber to communicate slightly with each other when the orbiting of the orbiting scroll has caused the Oldham's keyway and the sealing member to overlap each other.

12. A scroll fluid machine according to claim 9, wherein the tongue part is formed on the plate and is so formed that when the orbiting of the orbiting scroll has caused the Oldham's keyway and the plate to overlap each other, the Oldham's keyway and the high pressure chamber may slightly communicate with each other through an opening formed in the vicinity of the inner peripheral edge of the Oldham's keyway.

13. A scroll fluid machine according to claim 9, wherein the tongue part is formed on the plate and the front face of the tongue part or the back face of the orbiting scroll has a communicating groove formed to allow the Oldham's keyway and the high pressure chamber to communicate slightly with each other when the orbiting of the orbiting scroll has caused the Oldham's keyway and the plate to overlap each other.

* * * * *